US007742715B2

(12) United States Patent
Ohnishi

(10) Patent No.: US 7,742,715 B2
(45) Date of Patent: Jun. 22, 2010

(54) CHARGING SYSTEM, IMAGE FORMING APPARATUS, INFORMATION PROCESSING DEVICE, CHARGING METHOD, AND PROGRAM FOR MANAGING CHARGE ADJUSTMENT ACCORDING TO CONTENTS OF A TROUBLE

(75) Inventor: Hidenori Ohnishi, Yamato-Koriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 681 days.

(21) Appl. No.: 11/700,229

(22) Filed: Jan. 31, 2007

(65) Prior Publication Data

US 2007/0196121 A1 Aug. 23, 2007

(30) Foreign Application Priority Data

Feb. 17, 2006 (JP) ..... 2006-041220

(51) Int. Cl.
*G03G 21/02* (2006.01)

(52) U.S. Cl. ..... 399/79

(58) Field of Classification Search ..... 399/8, 399/79

See application file for complete search history.

(56) References Cited

U.S. PATENT DOCUMENTS 6,571,071 B2 * 5/2003 Kanoshima et al. ..... 399/79
7,286,782 B2 * 10/2007 Nomura et al. ..... 399/79
7,339,689 B2 * 3/2008 Hiraoka ..... 399/79
7,480,077 B2 * 1/2009 Peeters ..... 399/79

FOREIGN PATENT DOCUMENTS

JP 6-243338 A 9/1994
JP 2000-181307 A 6/2000
JP 2004-151703 A 5/2004

* cited by examiner

*Primary Examiner*—William J Royer
(74) *Attorney, Agent, or Firm*—Birch, Stewart, Kolasch & Birch, LLP

(57) ABSTRACT

A charging system includes a plurality of image forming apparatuses, and an information processing device that manages a charging processing on the image forming apparatus. The image forming apparatus detects a trouble occurring on the image forming apparatus, and transmits a total number of output papers put out of the image forming apparatus and the detected contents of trouble to the information processing device as a use condition of the image forming apparatus. The information processing device calculates a total amount of service charge on the basis of the total number of output papers transmitted from the image forming apparatus, and also calculates an amount of deduction corresponding to the contents of trouble transmitted from the image forming apparatus. The information processing device deducts the amount of deduction from the total amount of service charge to calculate an amount of charge on the image forming apparatus.

14 Claims, 10 Drawing Sheets

FIG. 7

| PROCESSING MODE | ITEM | CHARGE (DEDUCTION) | NOTE |
|---|---|---|---|
| PRINTING PROCESSING MODE | PAPER EXPENSE | ▲xxxYEN | JAM AFTER PASSAGE THROUGH RESIST ROLLERS |
| | | 0 YEN | JAM BEFORE PASSAGE THROUGH RESIST ROLLERS |
| | TONER EXPENSE | ▲xxxYEN | JAM AFTER PASSAGE THROUGH RESIST ROLLERS |
| | | 0 YEN | JAM BEFORE PASSAGE THROUGH RESIST ROLLERS |
| | PRINTER MECHANISM CONSUMPTION EXPENSE | | |
| | FIXING PORTION | ▲xxxYEN | FIXING ROLLER, CLEANING ROLLER, ETC. |
| | DEVELOPING PORTION | ▲xxxYEN | DEVELOPER, DEVELOPING ROLLER, ETC. |
| | PHOTOSENSITIVE MATERIAL | ▲xxxYEN | |
| | OTHERS | ▲xxxYEN | |
| | SCANNER MECHANISM CONSUMPTION EXPENSE | ▲xxxYEN | COPY MODE |
| | | 0 YEN | PRINT MODE, FAX RECEPTION MODE |
| | REGULAR MAINTENANCE EXPENSE | ▲xxxYEN | |
| DOCUMENT READING PROCESSING MODE | PAPER EXPENSE | 0 YEN | |
| | TONER EXPENSE | 0 YEN | |
| | PRINTER MECHANISM CONSUMPTION EXPENSE | | |
| | FIXING PORTION | 0 YEN | |
| | DEVELOPING PORTION | 0 YEN | |
| | PHOTOSENSITIVE MATERIAL | 0 YEN | |
| | OTHERS | 0 YEN | |
| | SCANNER MECHANISM CONSUMPTION EXPENSE | ▲xxxYEN | |
| | REGULAR MAINTENANCE EXPENSE | ▲xxxYEN | |
| | LINE CONNECTION EXPENSE | ▲xxxYEN | FAX TRANSMISSION MODE, ETC. |

FIG. 11

CHARGING INFORMATION (1) TOTAL AMOUNT OF SERVICE CHARGE

A YEN/PAPER × B PAPER = C YEN (2) AMOUNT OF DEDUCTION

TROUBLE D × E TIMES = F YEN

TROUBLE G × H TIMES = I YEN

+ ⋮ ⋮ ⋮

TOTAL = J YEN (3) AMOUNT OF CHARGE AFTER BALANCING (1) − (2) = (C − J) = K YEN

CHARGING SYSTEM, IMAGE FORMING APPARATUS, INFORMATION PROCESSING DEVICE, CHARGING METHOD, AND PROGRAM FOR MANAGING CHARGE ADJUSTMENT ACCORDING TO CONTENTS OF A TROUBLE

CROSS-NOTING PARAGRAPH

This Nonprovisional application claims priority under 35 U.S.C. §119 (a) on Patent Application No. 2006-041220 filed in JAPAN on Feb. 17, 2006, the entire contents of which are hereby incorporated herein by references.

FIELD OF THE INVENTION

The present invention relates generally to a charging system, an image forming apparatus, an information processing device, a charging method, and a program, and, more particularly, to a charging system, an image forming apparatus, an information processing device, a charging method, and a program that enable adjustment of an amount of charge according to the contents of a trouble, such as a paper jam.

BACKGROUND OF THE INVENTION

These days, more and more offices and stores, including convenience stores, have come to employ an image forming apparatus, such as a digital multi-function peripheral. Such an image forming apparatus installed in a store, etc., usually serves with a charging device, such as a coin rack, connected to the apparatus. In carrying out print work using the image forming apparatus, an operator (person who carries out the print work) puts a larger amount of money than necessary into the charging apparatus in advance. When copying starts, the charge for a sheet of copy is deducted from the prepaid money, and the balance of the prepayment is returned to the operator when copying is completed.

In carrying out maintenance/management service for such an image forming apparatus, the image forming apparatus is connected to a network so that a management center (server), etc., keeps checking the use condition of the apparatus and service personnel carry out maintenance work, supply work, etc., on a regular or necessary basis. In this form of maintenance/management service, a charging method in which a charging is executed according to the number of papers put out (printed out) of the image forming apparatus is employed. For example, according to the method, an amount of charge is calculated based on the number of papers used in operation of the image forming apparatus to collect a service charge from a user (company, store, etc.).

A conventional charging system has been known, which system enables adjustment of an amount of charge on an image forming apparatus according to the volume of expendable supplies (e.g., see Japanese Laid-Open Patent Publication No. 2004-151703). The charging system has a plurality of printers and an information processing device, charging on each printer according to the number of papers printed out. The system charges a different amount of money for one printed out paper according to a contract providing different maintenance details.

When an image forming apparatus is installed in a store, as described above, and such a trouble as a paper jam is caused by the apparatus itself during a printing processing, the paper jam prevents the apparatus from putting out a printed matter for an operator (person who carries out print work), so that the store refunds the payment for the missed printed matter to the operator. The store, on the other hand, receives no refund from a management center (base station) in charge of maintenance/management for this matter.

As a result, the charge for the printed matter missed due to the jam is also included in a sum on a bill sent from the management center to the store, which sum is determined based on the charge for papers used, for such expendable supplies as toner, for use of the image forming apparatus, for maintenance work, etc. The user (company, store, etc.), therefore, faces a bill larger in sum than a bill payable for the number of printed matters actually produced by the image forming apparatus. This problem also arises in an application of the invention described in Japanese Laid-Open Patent Publication No. 2004-151703.

SUMMARY OF THE INVENTION

The object of the present invention is to provide a charging system, an image forming apparatus, an information processing device, a charging method, and a program that enable adjustment of an amount of charge according to the contents of a trouble, such as a paper jam, and, specifically, to enable each of image forming apparatuses connected to a network to detect such a trouble as paper jam so that the number of papers involved in the trouble is deducted from the total number of papers used according to the contents of the trouble, and a user (company, store, etc.) is charged for service by the image forming apparatus on the basis of a result of the deduction.

Another object of the present invention is to provide a charging system comprising at least one image forming apparatus and an information processing device for managing a charging processing on the image forming apparatus, the image forming apparatus and the information processing device being connected via a network, wherein the image forming apparatus has a trouble detecting portion that detects a trouble occurring on the image forming apparatus, and a use condition transmitting portion that transmits a total number of output papers outputted from the image forming apparatus and contents of the trouble detected by the trouble detecting portion to the information processing device, the total number and the contents of trouble being transmitted as a use condition of the image forming apparatus, and wherein the information processing device has a charge calculating portion that calculates a total amount of service charge on the basis of the total number of output papers transmitted from the image forming apparatus and the amount of deduction corresponding to the contents of trouble transmitted from the image forming apparatus, and that deducts the amount of deduction from the total amount of service charge to calculate an amount of charge on the image forming apparatus.

Another object of the present invention is to provide a charging system, wherein the total amount of service charge is an amount that is calculated by multiplying the total number of output papers from the image forming apparatus by a charge for one paper based on a charge for use of the image forming apparatus, for expendable supplies, and for regular maintenance.

Another object of the present invention is to provide a charging system, wherein the amount of deduction is an amount that is calculated by adding up an amount of deduction per trouble for every contents of trouble, the amount of deduction per trouble being obtained by multiplying the frequency of each type of trouble occurred on the image forming apparatus by an amount corresponding to contents of each trouble.

Another object of the present invention is to provide a charging system, wherein the amount of money corresponding to the contents of trouble varies for one output operation of the image forming apparatus according to a processing mode of the image forming apparatus.

Another object of the present invention is to provide a charging system, wherein the image forming apparatus has an image forming portion that executes a printing processing on a recording paper, and an image reading portion that executes a reading processing on a manuscript image, and wherein a processing mode of the image forming apparatus consists of a printing processing mode for making the image forming portion operate, and an original image reading processing mode for making the image reading portion operate.

Another object of the present invention is to provide a charging system, wherein the amount of money corresponding to the contents of trouble varies according to a transfer position of a recording paper in an operation in the printing processing mode.

Another object of the present invention is to provide a charging system, wherein the image forming apparatus has a paper feeding tray that stores recording papers, and a resist roller that transfers a recording paper sent from the paper feeding tray to the image forming portion, and wherein the amount of money corresponding to the contents of trouble varies depending on whether the recording paper from the paper feeding tray has passed through the resist roller.

Another object of the present invention is to provide a charging system, wherein the amount of money corresponding to the contents of trouble includes each charge per one output operation of the image forming apparatus for use of the apparatus, for expendable supplies, and for regular maintenance when the recording paper from the paper feeding tray has already passed through the resist roller.

Another object of the present invention is to provide a charging system, wherein the amount of money corresponding to the contents of trouble includes each charge per one output operation of the image forming apparatus for use of the apparatus and for regular maintenance when the recording paper from the paper feeding tray has not passed through the resist roller yet.

Another object of the present invention is to provide a charging system, wherein the image forming apparatus has a communication portion that transmits manuscript image data read by the image reading portion to an external device via a communication line, and wherein the amount of money corresponding to the contents of trouble includes each charge per one output operation of the image forming apparatus for use of the apparatus, for regular maintenance, and for connection to the communication line in an operation in the manuscript reading processing mode.

Another object of the present invention is to provide a charging system, wherein the charge calculating portion eliminates contents of a trouble caused by a given operation from contents of troubles detected on the image forming apparatus.

Another object of the present invention is to provide a charging system, wherein the information processing device has a charging information transmitting portion that transmits charging information including an amount of charge on the image forming apparatus calculated by the charge calculating portion to the image forming apparatus, and wherein the image forming apparatus is capable of displaying or printing out the charging information received from the information processing device.

Another object of the present invention is to provide a charging system, wherein the information processing device has the charging information transmitting portion that transmits the charging information including the amount of charge on the image forming apparatus calculated by the charge calculating portion to another information processing device, and wherein another information processing device is capable of displaying or printing out the charging information received from the information processing device.

Another object of the present invention is to provide an image forming apparatus, comprising a communication portion that is connected to an information processing device for managing a charging processing on the image forming apparatus via a network; a trouble detecting portion that detects a trouble occurring on the image forming apparatus, and a use condition transmitting portion that transmits a total number of output papers outputted from the image forming apparatus and contents of the trouble detected by the trouble detecting portion as a use condition of the image forming apparatus to the information processing device.

Another object of the present invention is to provide an information processing device, comprising a communication portion that is connected to at least one image forming apparatus via a network and a charge calculating portion that calculates the total amount of service charge on the basis of a total number of output papers transmitted from the image forming apparatus and the amount of deduction corresponding to the contents of trouble transmitted from the image forming apparatus, and calculates the amount of charge on the image forming apparatus by deducting the amount of deduction from the total amount of service charge.

Another object of the present invention is to provide a charging method executed in a charging system comprising at least one image forming apparatus and an information processing device for managing a charging processing on the image forming apparatus, in which the image forming apparatus and the information processing device are connected via a network, wherein the method comprising the steps of causing the image forming apparatus to detect a trouble occurring on the image forming apparatus and causing the image forming apparatus to transmit a total number of output papers outputted from the image forming apparatus and contents of the detected trouble as a use condition of the image forming apparatus to the information processing device, wherein the method further includes a step of causing the information processing device to calculate the total amount of service charge on the basis of the total number of output papers transmitted from the image forming apparatus and the amount of deduction corresponding to the contents of trouble transmitted from the image forming apparatus, and to calculate the amount of charge on the image forming apparatus by deducting the amount of deduction from the total amount of service charge.

Another object of the present invention is to provide a program for executing functions of the charging system.

BRIEF DESCRIPTION OF THE DRAWINGS

FIG. 7 shows an example of a charging table;

FIG. 11 depicts an example of the charging information displayed on the digital multi-function peripheral or on the PC.

PREFERRED EMBODIMENTS OF THE INVENTION

Figure 1:
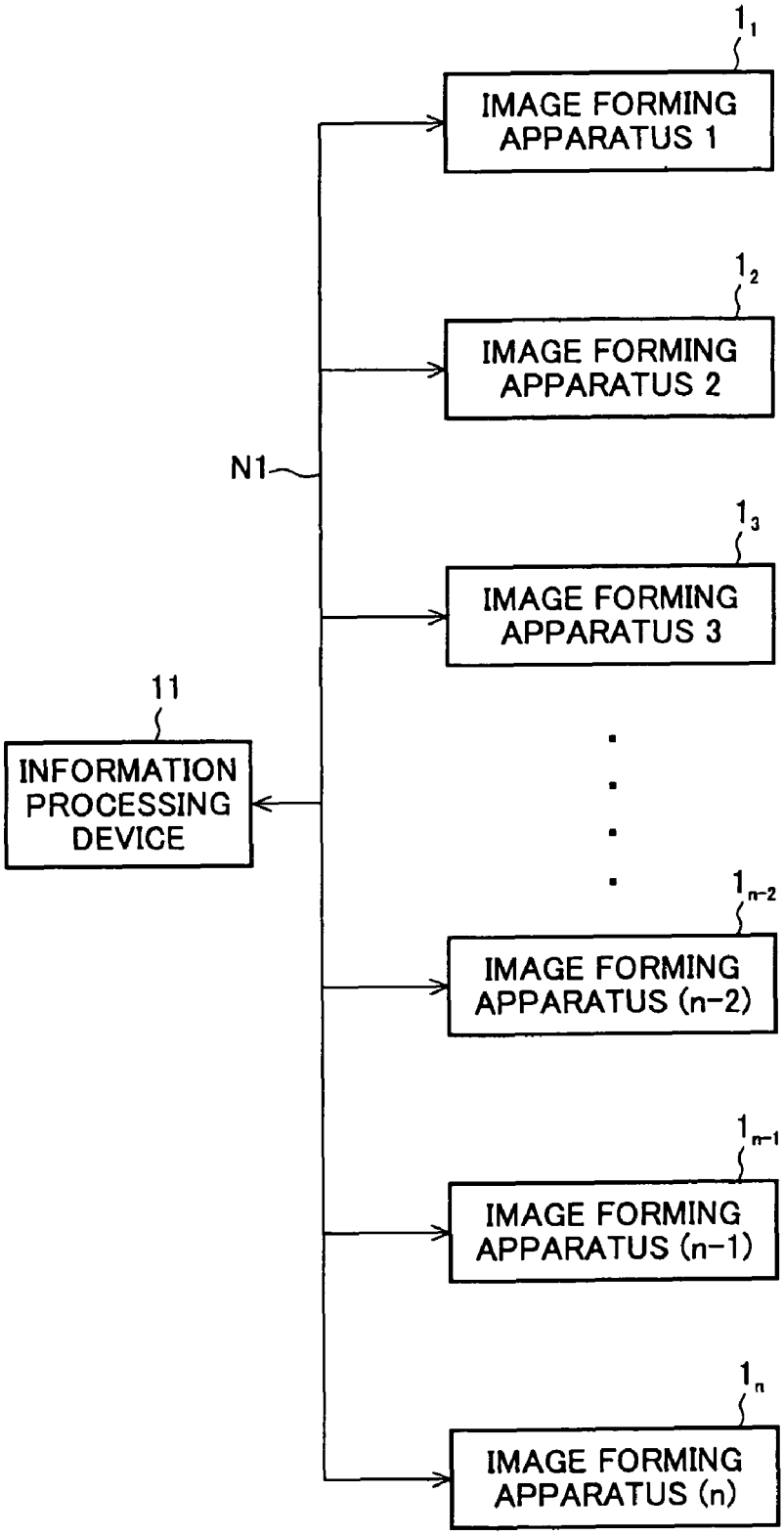
FIG. 1 depicts an example of a charging system according to an embodiment of the present invention.

FIG. 1 depicts an example of a charging system according to an embodiment of the present invention. As shown in FIG. 1, the charging system includes a plurality of image forming apparatuses $\mathbf{1}_1$ to $\mathbf{1}_n$ (hereinafter represented by image forming apparatus 1), and an information processing device 11, which is connected to the image forming apparatus 1 via a communication network N1 such as LAN, Internet, etc. An example that the image forming apparatus 1 is applied to a digital multi-function peripheral (hereinafter "digital multi-function peripheral 1") having functions of copying, printing, faxing, and scanning is explained below as a typical one.

Figure 2:
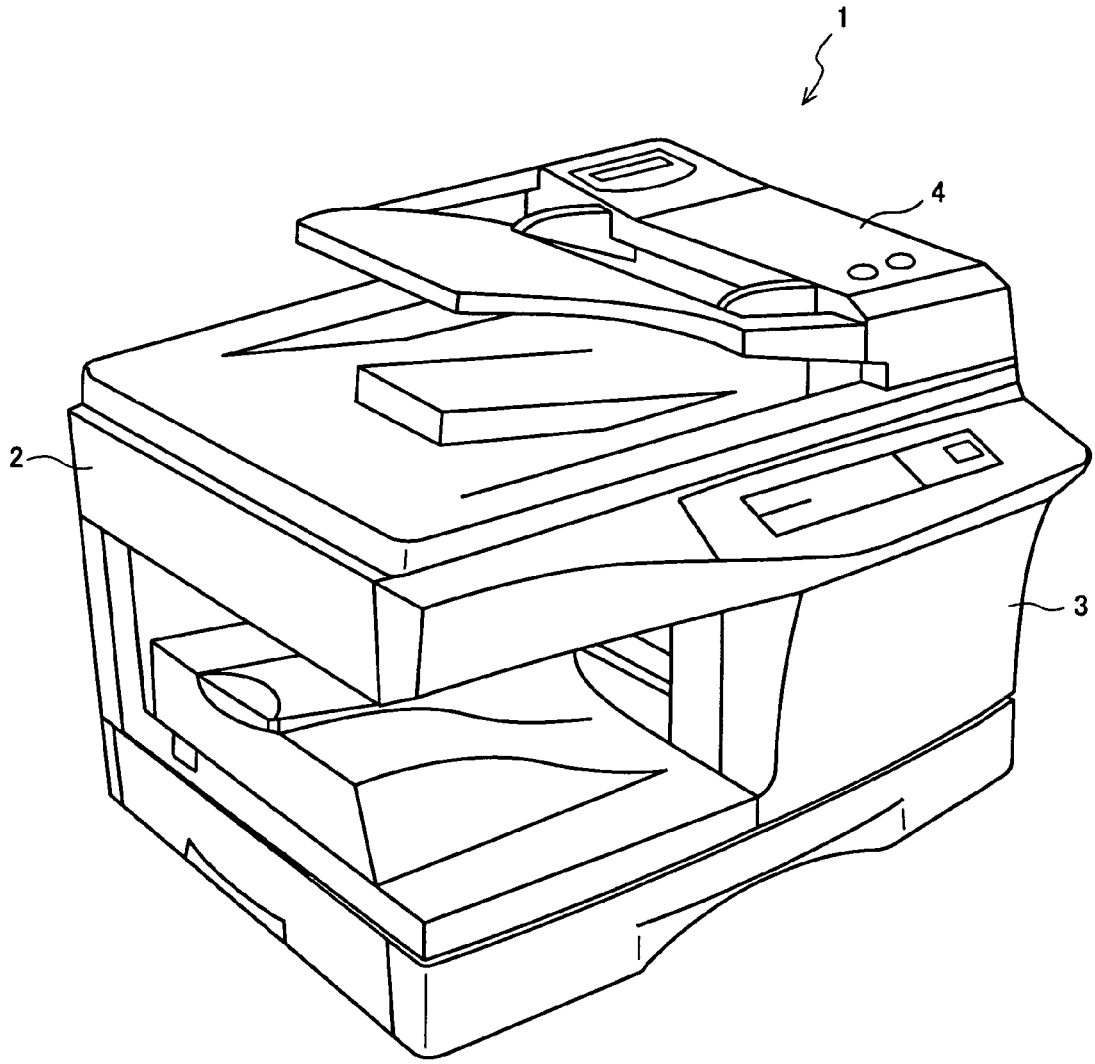
FIG. 2 is a perspective view of an example of the external structure of a digital multi-function peripheral according to the present invention.
Figure 3:
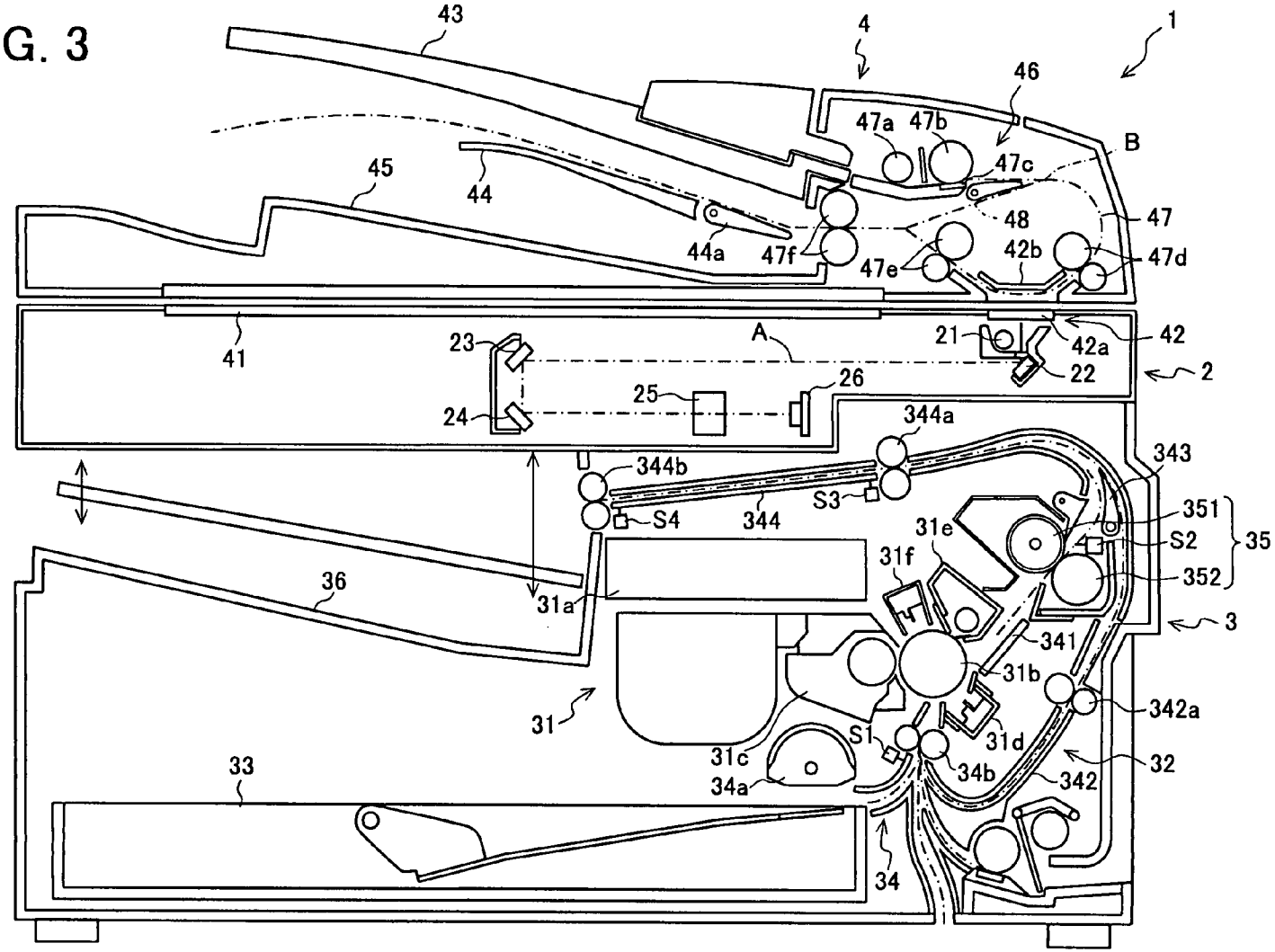
FIG. 3 depicts an example of the internal structure of the digital multi-function peripheral according to the present invention.

FIG. 2 is a perspective view of an example of the external structure of the digital multi-function peripheral 1 according to the present invention. The digital multi-function peripheral 1 includes a scanner (image reading portion) 2, a printer (image forming portion) 3, and an automatic document feeder 4. FIG. 3 depicts an example of the internal structure of the digital multi-function peripheral 1 according to the present invention. Each portion of the digital multi-function peripheral 1 is described with reference to FIG. 3.

<Scanner 2>

The scanner 2 is a portion that reads an image on a manuscript placed on a document board 41 made of transparent glass, etc., or an image on an original fed from the automatic document feeder 4 one after another, and produces image data. The scanner 2 includes an exposure light source 21, a plurality of reflecting mirrors 22, 23, 24, a focus lens 25, and a photoelectric conversion element (CCD: Charge Coupled Device) 26.

The exposure light source 21 emits light onto a manuscript, which is placed on the document board 41 of the automatic document feeder 4 or is transferred through the automatic document feeder 4. The reflecting mirrors 22, 23, 24 jointly reflect the light reflected from the manuscript, for example as the light path is shown in the dashed-dotted line A in FIG. 3, first to the left in FIG. 3, then downward, and then to the right to send the light to the focus lens 25.

In a reading operation of an image on a manuscript, when the manuscript is placed on the document board 41, the exposure light source 21 and each reflecting mirror 22, 23, 24 are scanned horizontally along the document board 41 to read the whole of an image on the manuscript. On the other hand, when the manuscript is transferred through the automatic document feeder 4, the exposure light source 21 and the reflecting mirrors 22, 23, 24 are fixed in the positions shown in FIG. 3, and the image is read when the manuscript passes through a document reading portion (which will be described later) of the automatic document feeder 4.

<Printer 3>

The printer 3 includes an image forming system 31 serving as an image processing portion, and a paper transfer system 32 serving as a paper transfer path.

The image forming system 31 has a laser scanning unit (LSU) 31*a*, and a drum-shaped photosensitive drum 31*b*. The LSU 31*a* emits a laser beam, which is based on manuscript image data obtained through photoelectric conversion by the CCD 26, onto the surface of the photosensitive drum 31*b*. The photosensitive drum 31*b* revolves in a fixed direction, and when it is exposed to the laser beam from the LSU 31*a*, an electrostatic latent image is formed on the surface of the photosensitive drum 31*b*.

On the outer periphery of the photosensitive drum 31*b*, a developer 31*c*, a transfer charger 31*d*, a cleaner 31*e*, a charge neutralizer (not shown), and an electrifier 31*f*, in addition to the LSU 31*a*, are disposed circumferentially in order. The developer 31*c* develops the electrostatic latent image formed on the surface of the photosensitive drum 31*b* into a visible image, using toner. The transfer charger 31*d* transfers the toner image formed on the surface of the photosensitive drum 31*b* to a recording paper. The cleaner 31*e* removes toner remaining on the surface of the photosensitive drum 31*b* after the toner image transfer. The charge neutralizer eliminates residual charges from the surface of the photosensitive drum 31*b*. The electrifier 31*f* applies DC voltage from a power supply, which is not shown, to the surface of the photosensitive drum 31*b* through contact electrification before the formation of the electrostatic latent image, thus electrifies the surface of the photosensitive drum 31*b*.

When an image is formed on a recording paper, the following process is carried out. The surface of the photosensitive drum 31*b* is electrified through contact with the electrifier 31*f* to have a given potential, and the LSU 31*a* emits a laser beam based on manuscript image data onto the surface of the photosensitive drum 31*b*. Then, the developer 31*c* forms a visible image on the surface of the photosensitive drum 31*b* using toner, which is followed by transfer of the toner image to the recording paper by the transfer charger 31*d*. Subsequently, toner remaining on the surface of the photosensitive drum 31*b* is removed by the cleaner 31*e* and residual charges on the surface of the photosensitive drum 31*b* are eliminated by the charge neutralizer.

A cycle of operation of forming an image on a recording paper is thus ended. This cycle is repeated to form images consecutively on a plurality of recording papers.

The paper transfer system 32, functioning as a paper feeding portion, transfers recording papers stored in a paper cassette 33 one by one to allow the image forming system 31 to carry out image formation, and sends out a recording paper bearing a formed image to a paper ejecting tray 36 serving as an ejecting portion. For convenience, the side from which a recording paper starts to transfer, i.e., the paper cassette 33 side, is regarded as the upstream side, and the paper ejecting side is regarded as the downstream side.

The paper transfer system 32 has a paper transfer path 34 which is located on the upstream side in a paper transfer direction and through which a recording paper from the paper cassette 33 is transferred toward a branch nail 343, and a paper ejecting path 344 which is located on the downstream side in the paper transfer direction and through which a recording paper bearing an image formed at the image forming system 31 is transferred toward the paper ejecting tray 36. The paper ejecting path 344 is provided with transfer roller 344*a* and paper ejecting roller 344*b*.

The paper transfer path 34 has a main transfer path 341, and a reverse transfer path 342 which is provided with transfer roller 342*a* working for consecutive transfer of a plurality of recording papers. The main transfer path 341 has one end facing the ejecting side of the paper cassette 33, and the other end connected to the paper ejecting path 344. The reverse transfer path 342 has one end that is connected to the main transfer path 341 at a point further upstream (lower side in FIG. 3) than the position the transfer charger 31*d* is located, and the other end that is connected to the main transfer path 341 at a point further downstream (upper side in FIG. 3) than the position the transfer charger 31*d* is located.

A pick-up roller 34*a* having a semicircular section is disposed at the upstream end (the part facing the ejecting side of the paper cassette 33) of the main transfer path 341. The revolution of the pick-up roller 34*a* intermittently feeds the recording papers out of the paper cassette 33 one by one into the main transfer path 341.

A resist roller 34*b* is disposed further upstream than the located position of the transfer charger 31*d* along the main transfer path 341. The resist roller 34*b* transfers a recording paper while aligning a toner image on the surface of the photosensitive drum 31*b* and the recording paper. A fixing device 35 is disposed further downstream than the located position of the transfer charger 31*d* along the main transfer path 341. The fixing device 35 fixes a toner image transferred to a recording paper by putting the paper through a nipping portion between a heating roller 351 and a pressure roller 352.

The branch nail 343 is disposed at a connection point between the main transfer path 341 and the downstream end (upper side in FIG. 3) of the reverse transfer path 342. The branch nail 343 can be swung around a horizontal axis to move between a first position indicated by a continuous line in FIG. 3 and a second position to which the branch nail 343 is swung counterclockwise from the first position to open the reverse transfer path 342. When the branch nail 343 is at the first position, a recording paper is transferred toward the paper ejecting path 344. When the branch nail 343 is at the second position, the recording paper can be supplied to the reverse transfer path 342.

When the recording paper is supplied to the reverse transfer path 342 (supplied to the reverse transfer path 342 by so-called switchback transfer), the transfer roller 342*a* transfer the recording paper to the upstream side of the resist roller 34*b*, where the recording paper is reversed and is transferred through the main transfer path 341 again toward the transfer charger 31*d*. This means that the recording paper is reversed to be ready for image formation on the back face of the paper.

Recording papers are stored in the paper cassette 33, at the front end of which the semilunar pick-up roller 34*a* is disposed and feeds the recording papers. A detecting sensor S1 for detecting the passage of a recording paper is provided near the upstream side of the resist roller 34*b*, which aligns a toner image on the photosensitive drum 31*b* and a recording paper on the basis of a signal from the detecting sensor S1. The transfer charger 31*d* transfers the toner image on the photosensitive drum 31*b* to the recording paper.

A detecting sensor S2 for detecting the passage of a recoding paper is provided near the downstream side of the fixing device 35 consisting of the heating roller 351 and the pressure roller 352, which fix a toner image on a recording paper by heat. A detecting sensor S3 for detecting the passage of a recoding paper through the transfer roller 344*a* is provided near the downstream side of the transfer roller 344*a*. A detecting sensor S4 for detecting the passage of a recording paper is provided in front of the paper ejecting roller 344*b*.

<Automatic Document Feeder 4>

The automatic document feeder 4 is constructed as a so-called automatic double-faced document transfer device. The automatic document feeder 4 can operate as a sheet mobile type, and includes a document tray 43, an intermediate tray 44, a document ejecting tray 45 serving as a document ejecting portion, and a document transfer system 46 that transfers a manuscript through the trays 43, 44, 45.

The document transfer system 46 has a main transfer path 47 trough which a manuscript placed on the document tray 43 is transferred to the intermediate tray 44 or to the document ejecting tray 45 via a document reading portion 42, and a subtransfer path 48 through which a manuscript on the intermediate tray 44 is supplied to the main transfer path 47.

A document pick-up roller 47*a* and a separating roller 47*b* are disposed on the upstream end (part facing the ejection side of the document tray 43) of the main transfer path 47. Under the separating roller 47*b*, a separating plate 47*c* is disposed so that one of the manuscripts on the document tray 43 is sent through between the separating roller 47*b* and the separating plate 47*c* into the main transfer path 47 as the document pick-up roller 47*a* revolves. PS roller 47*d* is disposed further downstream than a junction (point B shown in FIG. 3) between the main transfer path 47 and the subtransfer path 48. The PS roller 47*d* adjusts the position of the front end of a manuscript to the image reading timing of the scanner 2, and supplies the manuscript to the document reading portion 42. In other words, the PS roller 47*d* temporarily stops the incoming manuscript from proceeding further, make the above timing adjustment, and then supply the manuscript to the document reading portion 42.

The document reading portion 42 has a platen glass 42*a* and a document holding plate 42*b*, between which the manuscript supplied from the PS roller 47*d* passes through. When the manuscript passes through, light emitted from the exposure light source 21 goes through the platen glass 42*a* and falls onto the manuscript, at which the scanner 2 obtains manuscript image data. To the back face (upper face) of the document holding plate 42*b*, a biasing force by a coil spring, which is not shown, is applied. This biasing force keeps the document holding plate 42*b* in contact with the platen glass 42*a* under a given press force, preventing the manuscript from separating upward from the platen glass 42*a* when the manuscript passes through the document reading portion 42.

Transfer roller 47*e* and document ejecting roller 47*f* are provided further downstream than the platen glass 42*a*. The manuscript, having passed across the platen glass 42*a*, further proceeds through the transfer roller 47*e* and document ejecting roller 47*f*, and is finally ejected to the intermediate tray 44 or to the document ejecting tray 45.

An intermediate tray oscillating plate 44*a* is disposed between the document ejecting roller 47*f* and the intermediate tray 44. The intermediate tray oscillating plate 44*a* has the oscillating center on its one end closer to the intermediate tray 44, and is capable of oscillating between a first position indicated in FIG. 3 and a second position flipped up from the first position. When the intermediate tray oscillating plate 44*a* is at the second position, a manuscript ejected out of the document ejecting roller 47*f* is delivered to the document ejecting tray 45. When the intermediate tray oscillating plate 44*a* is at the first position, on the other hand, the manuscript ejected out of the document ejecting roller 47*f* is delivered to the intermediate tray 44. When the manuscript is ejected to the intermediate tray 44, an edge of the manuscript is caught between the document ejecting roller 47*f*. While the manuscript's edge is caught, the document ejecting roller 47*f* revolves in reverse, which supplies the manuscript into the subtransfer path 48 and puts the manuscript further through the subtransfer path 48 back into the main transfer path 47. The reverse revolution of the document ejecting roller 47*f* is carried out as timing of sending the manuscript into the main transfer path 47 is adjusted to image reading timing. The above process enables the document reading portion 42 to read an image on the back face of the manuscript.

Figure 4:
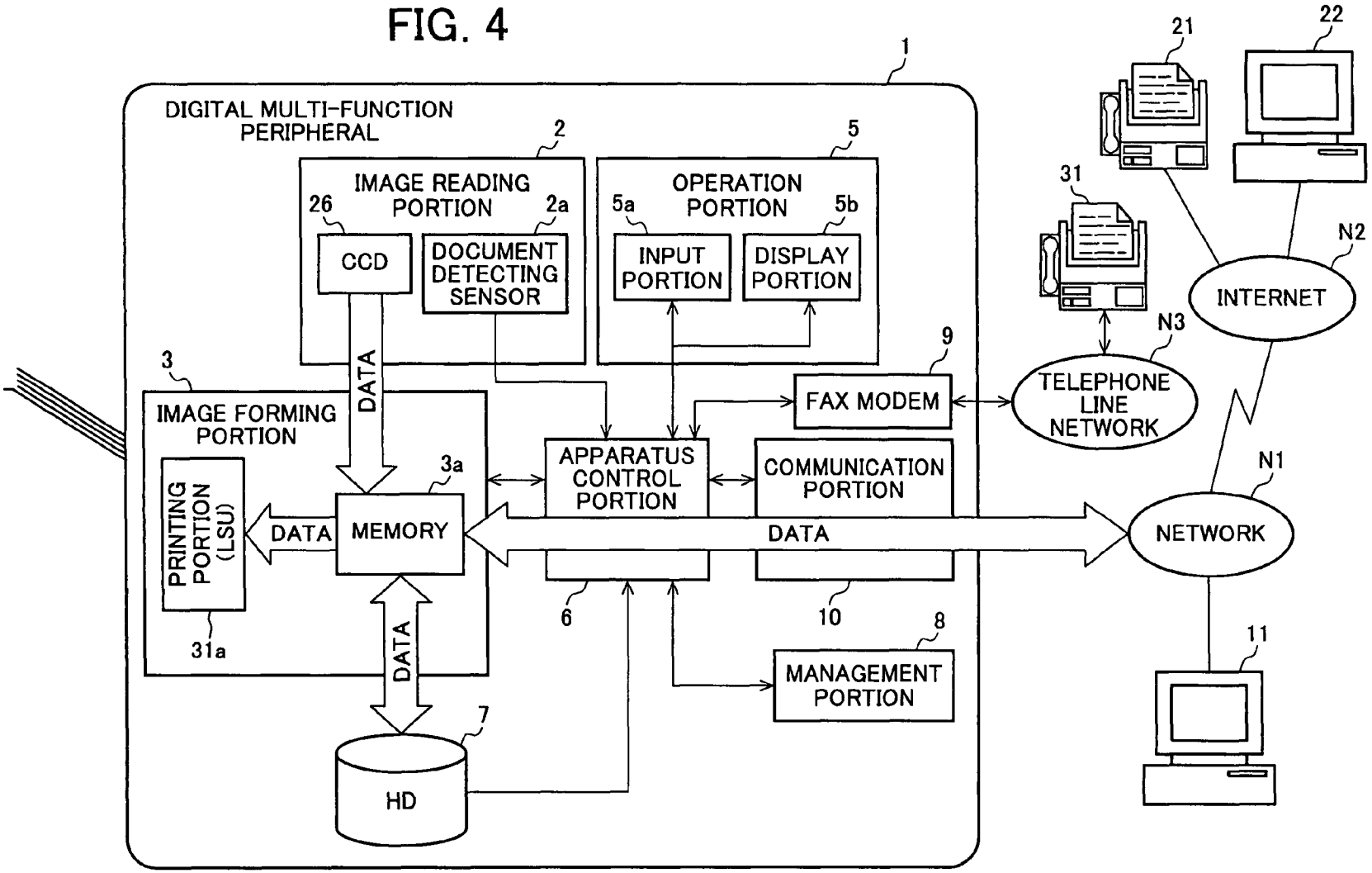
FIG. 4 is a functional block diagram of an example of the general structure of the digital multi-function peripheral according to the present invention.

FIG. 4 is a functional block diagram of an example of the general structure of the digital multi-function peripheral 1 according to the present invention. In FIG. 4, N1 denotes a communication network composed of a LAN, etc., N2 denotes the Internet, which is a wide area communication network, N3 denotes a telephone line network, 21 denotes a fax machine connected to the Internet N2, 22 denotes a terminal device, such as PC (Personal Computer), connected to the Internet N2 (hereinafter "PC"), and 31 denotes a fax machine connected to the telephone line network N3.

As shown in FIG. 4, the digital multi-function peripheral 1 includes the image reading portion (scanner) 2 that reads a manuscript to input image data, the image forming portion (printer) 3 that executes a printing processing of image data, an operation portion 5 that receives input from an operator, an apparatus control portion 6 that controls each of the functions the digital multi-function peripheral 1 has, a hard disk (HD) 7 that stores image data, etc., a management portion 8 serving as a memory that stores control information, setting information, etc., of the digital multi-function peripheral 1, a FAX modem 9 that communicates with the fax machine 31 via the telephone line network N3, and a communication portion 10 that communicates with an information processing device 11 via the communication network N1 and with the fax machine 21 and the PC 22 via the Internet N2.

Each portion of the digital multi-function peripheral 1 shown in FIG. 4 will now be described.

The digital multi-function peripheral 1 is provided with the apparatus control portion 6 composed of a CPU carrying out computation, a RAM storing temporal information accompanying computation, etc. The apparatus control portion 6 includes a ROM storing a control program for controlling the digital multi-function peripheral 1. To the apparatus control portion 6, the management portion 8 is connected, which is the memory that stores management information (various pieces of control information) for managing processes executed by the digital multi-function peripheral 1.

To the apparatus control portion 6, the image reading portion 2 is connected, which reads an image recorded on a manuscript to generate image data. The image reading portion 2 has the CCD 26 that takes in a manuscript image in the form of image data, and a document detecting sensor 2*a* that detects the presence/absence of a manuscript set on the document board 41, the automatic document feeder 4 (document tray 43), etc.

To the apparatus control portion 6, the image forming portion 3 is also connected, which functions as the image forming portion that forms image data on a recording paper. The image forming portion 3 has a memory 3*a* that stores image data temporarily, and the LSU 31*a* that forms an image out of the image data stored in the memory 3*a* to record the formed image on a recording paper.

To the apparatus control portion 6, a FAX modem 9 performing fax communication is also connected. The FAX modem 9 is connected to the telephone line network N3. The digital multi-function peripheral 1 can transmit image data generated by the image reading portion 2 to the other fax machine 31 via the telephone line network N3 connected to the FAX modem 9 by a fax communication. The digital multi-function peripheral 1 can also cause the FAX modem 9 to receive image data transmitted from the other fax machine 31 via the telephone line network N3, and cause the image forming portion 3 to form an image out of the received image data.

To the apparatus control portion 6, the communication portion 10 is also connected, which works to allow the digital multi-function peripheral 1 to receive/transmit information from/to external equipment. The communication portion 10 can be connected to the communication network N1, such as in-house LAN, to which the information processing device 11 can be connected. When the digital multi-function peripheral 1 is in an ordinary operation state to run singly, the communication portion 10 is connected to the communication network N1, exchanging information with the information processing device 11 via the communication network N1.

The communication network N1 is connected to the Internet N2, which is a wide area communication network. The communication portion 10 is thus able to receive image data from the fax machine 21 or the external PC 22, which is connected to the Internet N2, via the communication network N1 and Internet N2, through such a transmission method of attaching image data to an e-mail.

To the apparatus control portion 6, the operation portion 5 receiving operation input from a user is connected. The operation portion 5 consists of an input portion 5*a* composed of a touch panel or numeric keypad, etc., which is operated by the user to enter such information as a control command, and a display portion 5*b* composed of a liquid crystal panel, etc., which displays information necessary for the operation. An authentication code for authenticating a user or operator of the digital multi-function peripheral 1 is put into the operation portion 5. The authentication code may be put into the operation portion 5 from external equipment via the FAX modem 9 or communication portion 10.

To the apparatus control portion 6, the hard disk (HD) 7 is also connected. The HD 7 stores such image data related to image processing as image data generated by the image reading portion 2.

Operation examples related to image processing modes included in the digital multi-function peripheral 1 will be described.

<Copy Mode>

When the digital multi-function peripheral 1 according to the present embodiment is used as a copier, image data read from a manuscript by the image reading portion 2 is output as a copy from the image forming portion 3.

The image reading portion 2 has the CCD 26, thus capable of electronically reading an image on a manuscript set at a reading position. The read manuscript image data is completed as output data in the memory 3*a*, and is stored temporarily in the HD 7. When a plurality of manuscripts are processed, the above reading and storage operation is repeated. Subsequently, based on a processing mode specified through the operation portion 5, the image data stored in the HD 7 is read out sequentially at proper timing, and is sent to the memory 3*a*. The image data is then transferred from the memory 3*a* to the LSU 31*a* in line with timing for writing the data into the LSU 31*a*.

Likewise, when read image data is printed on a plurality of papers, the data is stored as output data in the HD 7 page by page, from which the data is sent to the memory 3*a* in line with an output mode. This process is repeated the same times as the number of papers to be printed. The data in the memory 3*a* is then transferred to the LSU 31*a* in line with timing for writing the data into the LSU 31*a*.

<Printer Mode>

When the digital multi-function peripheral 1 according to the present embodiment is used as a printer, image data received through the communication portion 10 is output from the image forming portion 3 via the memory 3*a*, etc.

The communication portion 10 receives image data from the communication network N1 or the PC 22 connected to the Internet N2, etc. The received image data is sent as output image data to the memory 3*a* page by page, and is stored temporarily in the HD 7. The image data is then sent back from the HD 7 to the memory 3*a*, and is transferred to the LSU 31*a* in the same manner as in the case of an application in the form of a copier.

<Scanner Mode>

When the digital multi-function peripheral 1 according to the present embodiment is used as a network scanner, image data from a manuscript read by the image reading portion 2 can be transmitted from the communication portion 10 to the PC 22, etc., via the communication network N1, etc. In this mode, as in other modes, the CCD 26 incorporated into the image reading portion 2 reads the manuscript electronically. The read manuscript image data is completed as output data in the memory 3*a*, and is stored temporarily in the HD 7. The data is then sent back from the HD 7 to the memory 3*a*, and is transmitted from the communication portion 10 to a transmission destination specified through the operation portion 5 after communication with the transmission destination has been established.

<Fax Mode>

The communication portion 10 can be connected to the fax machine 21 via the communication network N1 and Internet N2. The FAX modem 9 can be connected to the fax machine 31 via the telephone line network N3. The same operation as carried out in other modes is carried out when the digital multi-function peripheral 1 according to the present embodiment is used as a fax machine, which enables the digital multi-function peripheral 1 to transmit/receive image data to/from external equipment.

The apparatus control portion 6 controls each portion constituting the digital multi-function peripheral 1, monitoring operation instructions from the input portion 5*a*, which is composed of a tablet, a group of keys, etc., and is formed on the operation portion 5, and accurately displaying guiding information to be given to an operator, such as information of the status of the digital multi-function peripheral 1, via the display portion 5*b*. The management portion 8 manages information on each portion put under control of the apparatus control portion 6. Referring to this information, the apparatus control portion 6 controls overall operation of the digital multi-function peripheral 1.

In FIGS. 3 and 4, the apparatus control portion 6 has a function of counting the number of output papers put out of the digital multi-function peripheral 1, that is, counting the number of papers put out as copy output, print output, and fax output, the output involving processes at the image forming portion 3. A value given by the counting is equivalent to the total number of output papers from the digital multi-function peripheral 1. Usually, the total number of output papers is multiplied by the charge for one paper, which is based on the charge for use of the digital multi-function peripheral 1, for expendable supplies, such as recording papers and toner, and for regular maintenance, to calculate the total amount of service charge. For example, when the charge for one sheet of black/white A4 paper is determined to be 10 yen, the total number of output papers of 100 in a given period brings a calculation result of the total amount of service charge of 1,000 yen for the period.

Conventionally, when a paper is wasted because of a jam caused by a trouble of the digital multi-function peripheral 1, the wasted paper is also included in counting the total number of output papers. As a result, the charge for the wasted paper is added to the total amount of service charge, thus rendered payable to a user (company, store, etc.). In contrast, the present invention offers a charging system corresponding to the actual condition of use. According to the system, a user loss (charge for expendable supplies of recording papers, toner, etc., for use of the apparatus, for regular maintenance, etc.) due to a jam, etc., caused by a trouble of the digital multi-function peripheral 1 is deducted from the total amount of service charge to charge an amount corresponding to the actual condition of use. In the following description, "user" refers to a company, store, etc.

The detecting sensors S1 to S4 shown in FIG. 3 correspond to a trouble detecting portion according to the present invention, and are connected to the apparatus control portion 6. When such a trouble as a paper jam occurs in the paper transfer system 32 (main transfer path 341, reverse transfer path 342, paper ejecting path 344) of the digital multi-function peripheral 1, the detecting sensors S1 to S4 detect the jam, outputting a detection signal to the apparatus control portion 6. Based on the detection signal from the detecting sensors S1 to S4, the apparatus control portion 6 identifies a spot where the jam occurs, stops the roller involved in the jam, and puts a display informing of the occurrence and spot of the jam on the display portion 5*b*.

The document transfer system 46 (main transfer path 47, subtransfer path 48) of the automatic document feeder 4 is also provided with detecting sensors (trouble detecting portion according to the present invention), which are not shown. The sensors are provided properly near a plurality of rollers among the document pick-up roller 47*a*, separating roller 47*b*, PS roller 47*d*, transfer roller 47*e*, and manuscript ejecting roller 47*f*, and are connected to the apparatus control portion 6. In the same manner as the above detecting sensors S1 to S4 operate, when such a trouble as a paper jam occurs in the document transfer system 46 (main transfer path 47, subtransfer path 48), the detecting sensor detects the jam, outputting a detection signal to the apparatus control portion 6.

Subsequently, following the same course of processing as in the case of the paper transfer system 32, the apparatus control portion 6 identifies a spot where the jam occurs based on the detection signal from the detecting sensors not shown, stops the roller involved in the jam, and puts a display informing of the occurrence and spot of the jam on the display portion 5*b*. In the following description, the detecting sensors S1 to S4 arranged in the image forming portion 3 will be explained as a typical operational example.

The apparatus control portion 6 grasps the total number of output papers put out of the digital multi-function peripheral 1 and the contents of a trouble (frequency and spot, etc., of occurrence of every type of trouble) detected by the detecting sensors S1 to S4 as a use condition of the digital multi-function peripheral 1, and stores the use condition in the HD 7 or the management portion 8 for each job. The communication portion 10 then transmits the use condition of the digital multi-function peripheral 1, which is stored in the HD 7 or management portion 8, to the information processing device 11 via the communication network N1 for each job or each given period. The communication portion 10 serves as a use condition transmitting portion according to the present invention.

Figure 5:
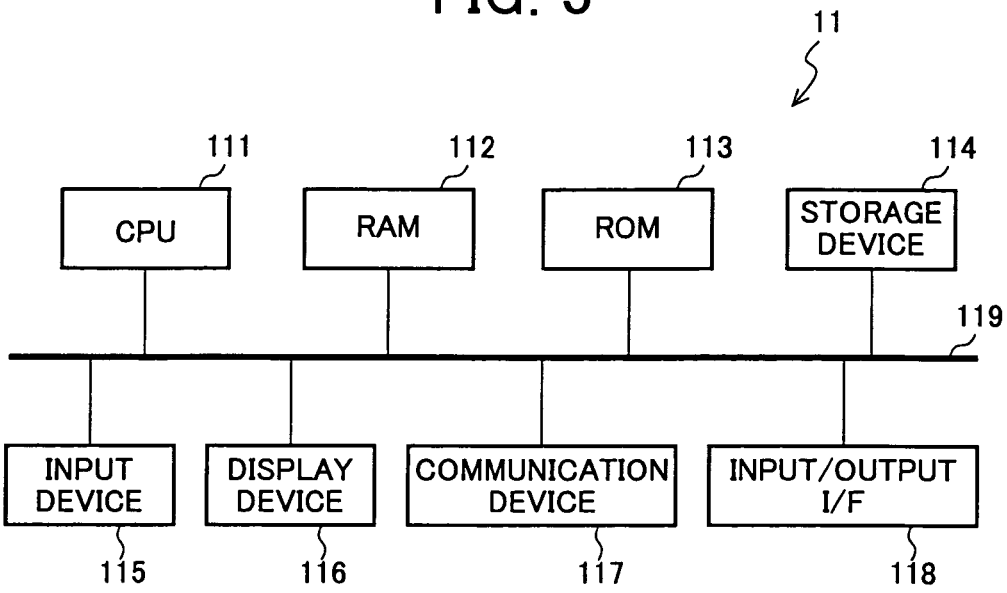
FIG. 5 is a block diagram of an example of the hardware structure of an information processing device according to the present invention.

FIG. 5 is a block diagram of an example of the hardware structure of the information processing device 11 according to the present invention. The information processing device 11, which is a general-purpose computer, includes a CPU 111 that controls operation of each portion, a RAM 112 that is a work area, a ROM 113 that is a storage area for a control program, data, etc., a storage device 114 composed of a hard disk, etc., an input device 115 that is an input device composed of keyboards, a mouse, etc., a display device 116 composed of an LCD, etc., a communication device (communication portion) 117 that is connected to the communication network N1 to exchange data with the digital multi-function peripheral 1 or another information processing device, an input/output interface (input/output I/F) 118 that is connected to a printer, external recording medium, etc., and a system bus 119 that interconnects the above portions.

Figure 6:
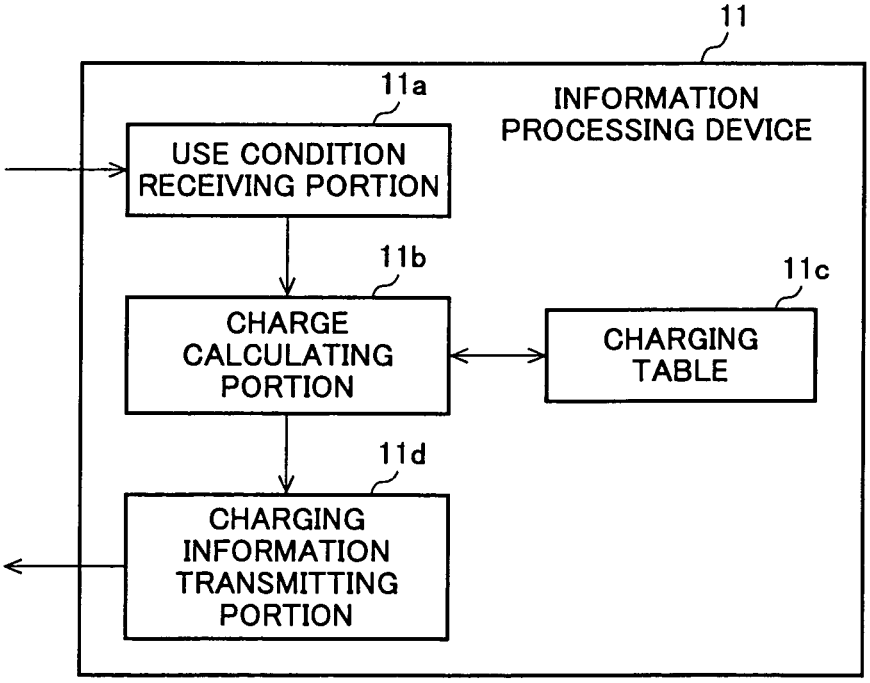
FIG. 6 is a functional block diagram of an example of the structure of the information processing device depicted in FIG. 5.

FIG. 6 is a functional block diagram of an example of the structure of the information processing device 11 depicted in FIG. 5. The information processing device 11 is connected to the digital multi-function peripheral 1 through the communication device 117 via the communication network N1. The information processing device 11 includes a use condition receiving portion 11*a* that receives information of the use condition of the digital multi-function peripheral 1 from the digital multi-function peripheral 1, a charge calculating portion 11*b* that calculates the total amount of service charge on the basis of the total number of output papers included in the use condition and calculates an amount of deduction corresponding to the contents of a trouble included in the use condition as well to deduct the amount of deduction from the total amount of service charge to determine an amount of charge on the digital multi-function peripheral 1, a charging table 11*c* that lists memorized amounts of deduction corresponding to the contents of troubles, and a charging information transmitting portion 11*d* that transmits charging information, which includes the amount of charge calculated at the charge calculating portion 11*b*, to the digital multi-function peripheral 1 or to another information processing device.

The use condition receiving portion 11*a* and the charging information transmitting portion 11*d* shown in FIG. 6 are provided by the CPU 111 and the communication device 117, respectively. The charging table 11*c* is stored in the ROM 113 or in the memory 114. A program for causing the charge calculating portion 11*b* to execute its function is stored in the ROM 113 or in the memory 114, and is read temporarily into the RAM 112 by the CPU 111 for execution in a process involving the program.

FIG. 7 shows a structural example of the charging table 11*c*. Based on the use condition of the digital multi-function peripheral 1, the charge calculating portion 11*b* determines an amount of charge on the digital multi-function peripheral 1, using the charging table 11*c* and the equation (1) shown below.

$$\text{Amount of charge} = (\text{total amount of service charge}) - (\text{amount of deduction}) \qquad \text{equation (1)}$$

Here, the total amount of service charge is the amount that is calculated by multiplying the total number of output papers from the digital multi-function peripheral 1 by the charge for one output paper based on the charge for use of the digital multi-function peripheral 1, for expendable supplies, and for regular maintenance. The amount of deduction is the amount that is calculated by adding up an amount of deduction per trouble for every contents of trouble, which amount per trouble is obtained by multiplying the frequency of each type of trouble occurred on the digital multi-function peripheral 1 by the amount corresponding to the contents of each trouble. The amount corresponding to the contents of each trouble is the amount set in the charging table 11*c* (hereinafter "set amount"). Setting examples of the charging table 11*c* will then be described.

The set amount for one output operation by the digital multi-function peripheral 1 may be varied according to a processing mode of the digital multi-function peripheral 1. The processing mode includes a printing processing mode for bringing the image forming portion 3 into operation, and a manuscript reading processing mode for bringing the image reading portion 2 into operation. The one output operation means the operation for outputting one printed matter, for example, in a processing of copying, printing, fax reception, etc., when the digital multi-function peripheral 1 operates in the printing processing mode, and means the operation for reading one manuscript and yielding one output paper, for example, in a processing of copying, image data transmission, fax transmission, etc., when the digital multi-function peripheral 1 operates in the document reading processing mode.

Expense items that can be set in the charging table 11*c* includes, for example, a paper expense and a toner expense, which are the charge for expendable supplies, a printer mechanism consumption expense (fixing portion, developing portion, photosensitive material, and others) and a scanner mechanism consumption expense, which are the charge for use of the apparatus, and a regular maintenance expense. The set amount for one output operation by the digital multi-function peripheral 1 is determined to be different between the printing processing mode and the document reading processing mode.

According to the example shown in FIG. 7, a set amount is determined for each of the paper expense, toner expense, printer mechanism consumption expense, and regular maintenance expense in the printing processing mode because the printer 3 operates in this mode, where a set amount is determined also for the scanner mechanism consumption expense when a copy processing is involved. In the document reading processing mode, on the other hand, a set amount is determined for the scanner mechanism consumption expense, regular maintenance expense, and additionally for a line connection expense when a fax transmission processing, etc., is involved because the scanner 2 operates in this mode.

In the printing processing mode, a set amount may be varied according to the transfer position of a recording paper. For example, a set amount is varied for each of the paper feeding portion, transfer portion, fixing portion, etc., because the ease of jam clearing work depends on a spot where a jam occurs. For example, a set amount for a jam at the fixing portion, where jam clearing work is difficult, is determined to be higher than that at the paper feeding portion, where the work is relatively easy.

A set amount for the paper expense and for the toner expense may be varied depending on whether a recording paper sent out of the paper cassette 33, which is a paper feeding tray, has passed through the resist roller 34*b* shown in FIG. 3. The passage of the recording paper through the resist roller 34*b* is detected by the detecting sensor S1.

In a case of a jam occurring after the passage of a recording paper through the resist roller 34*b*, the recording paper has undergone a printing processing before the occurrence of the jam. For this reason, the charge for expendable supplies consumed in the printing processing (paper expense and toner expense) is included in an amount of deduction, in addition to the charge for use of the apparatus and for regular maintenance. In a case of a jam occurring before the passage of a recording paper through the resist roller 34*b*, the recording paper has not undergone the printing processing before the occurrence of the jam (the paper is available for reuse). Because of this, the charge for use of the apparatus and for regular maintenance are included in an amount of deduction while the charge for expendable supplies (paper expense and toner expense) is not deducted from the total charge, which gives a set amount for expendable supplies of "zero" yen.

In the printing processing mode, a set amount for the scanner mechanism consumption expense may be varied depending on whether a processing to execute is the copy processing or other processings (printing processing, fax reception processing). The copy process requires operation of the scanner 2 and the printer 3, so that the scanner mechanism consumption expense is included in an amount of deduction. Any one of other processings requires operation of only the printer 3, so that the scanner mechanism consumption expense is not deducted from the total charge, which gives a set amount for the scanner mechanism consumption expense of "zero" yen.

In the document reading processing mode, a processing to execute is either the image data transmission processing of transmitting read manuscript image data to an external terminal device (PC 22, etc.) or the fax transmission processing of transmitting the read manuscript image data to the fax machine 21 or 31. Both processings are executed under operation of the scanner 2, and involve no operation of the printer 3. For the document reading processing mode, therefore, the scanner mechanism consumption expense and the regular maintenance expense are included in an amount of deduction, and the line connection expense is additionally deducted for connection to the communication line when the fax transmission processing is executed.

Incidentally, if every trouble occurred on the digital multi-function peripheral 1 is taken to be the subject of charge deduction, a trouble caused by a user's error will also be included in the subject. As a result, the owner of the digital multi-function peripheral 1 ends up bearing a loss caused by the user, which is unnecessary. To prevent this from happening, the charge calculating portion 11*b* may eliminate the contents of a trouble caused by a given operation from the contents of troubles detected by the digital multi-function peripheral 1. This allows elimination of troubles caused by the user's error. For example, opening/closing of the exterior door or turning on/off of the main power supply during operation of the digital multi-function peripheral 1 is very likely the user's error. A jam caused by such an operation is, therefore, excluded from the subject of charge deduction.

Figure 8:
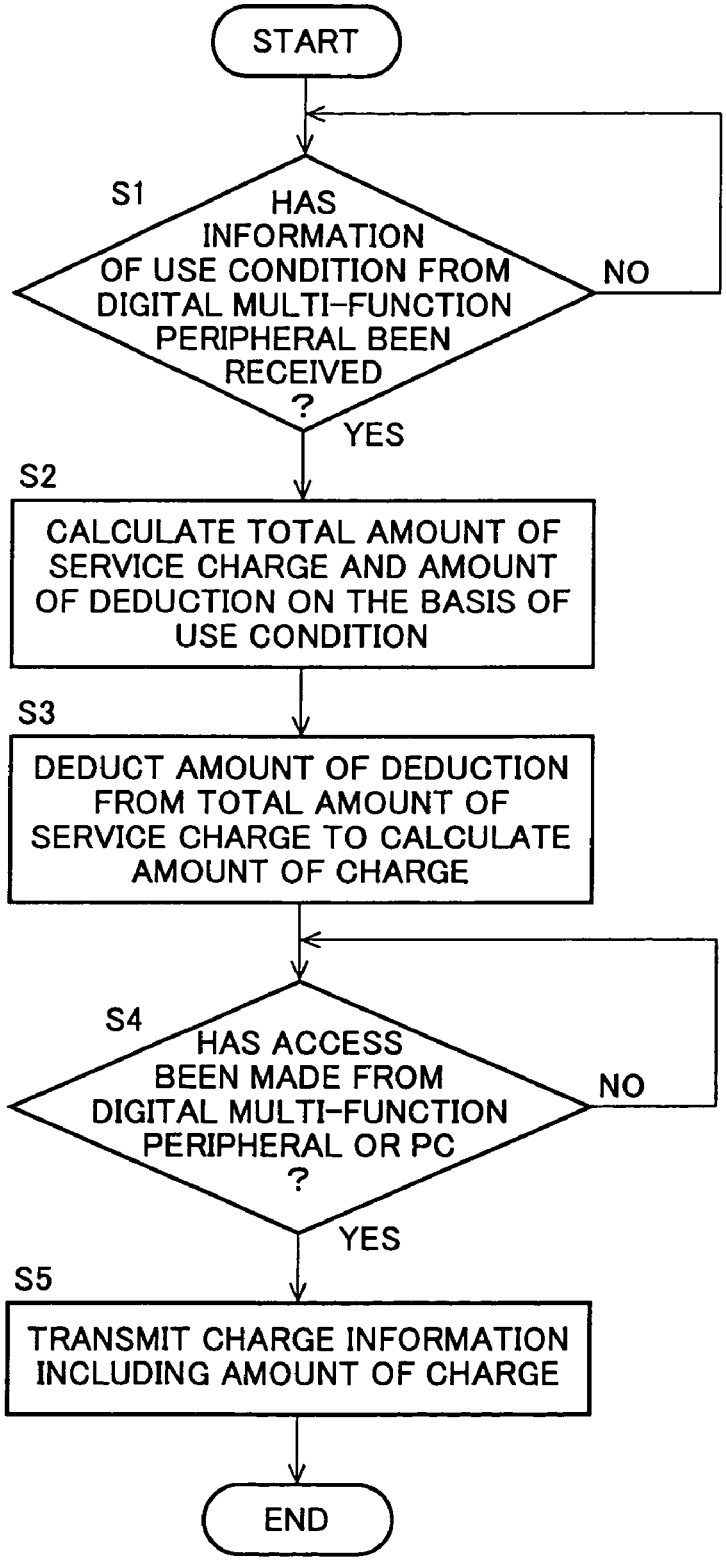
FIG. 8 is a flowchart for explaining an example of a charging method according to the charging system to which the present invention applies.

FIG. 8 is a flowchart for explaining an example of a charging method according to the charging system to which the present invention applies. At the start of the flowchart, the information processing device 11 determines on whether the processing device has received information of a use condition from the digital multi-function peripheral 1 (step S1). When receiving the information of use condition of the digital multi-function peripheral 1 (YES at step S1), the information processing device 11 calculates the total amount of service charge and an amount of deduction on the basis of the use condition (step S2). When receiving no information of use condition of the digital multi-function peripheral 1 (NO at step S1), the information processing device 11 waits for reception of use condition information at step S1.

The information processing device 11 then deducts the amount of deduction from the total amount of service charge to calculate an amount of charge on the digital multi-function peripheral 1 (step S3). Subsequently, the information processing device 11 determines on whether the processing device has received access from the digital multi-function peripheral 1 or the PC (step S4). When receiving access from the digital multi-function peripheral 1 or the PC (YES at step S4), the information processing device 11 sends charging information including the amount of charge calculated at step S3 to the digital multi-function peripheral 1 or to the PC (step S5). When receiving no access from the digital multi-function peripheral 1 or the PC (NO at step S4), the information processing device 11 waits for the access at step S4.

As shown in FIG. 6, the information processing device 11 is provided with the charging information transmitting portion 11*d*, which transmits the charging information including the amount of charge on the digital multi-function peripheral 1, the charging information being calculated by the charge calculating portion 11*b*, to the digital multi-function peripheral 1 or to the PC 22. The digital multi-function peripheral 1 or PC 22 is capable of displaying or printing out the charging information received from the information processing device 11. An example of the charging information is shown in FIG. 11, which will be referred to later.

Figure 9:
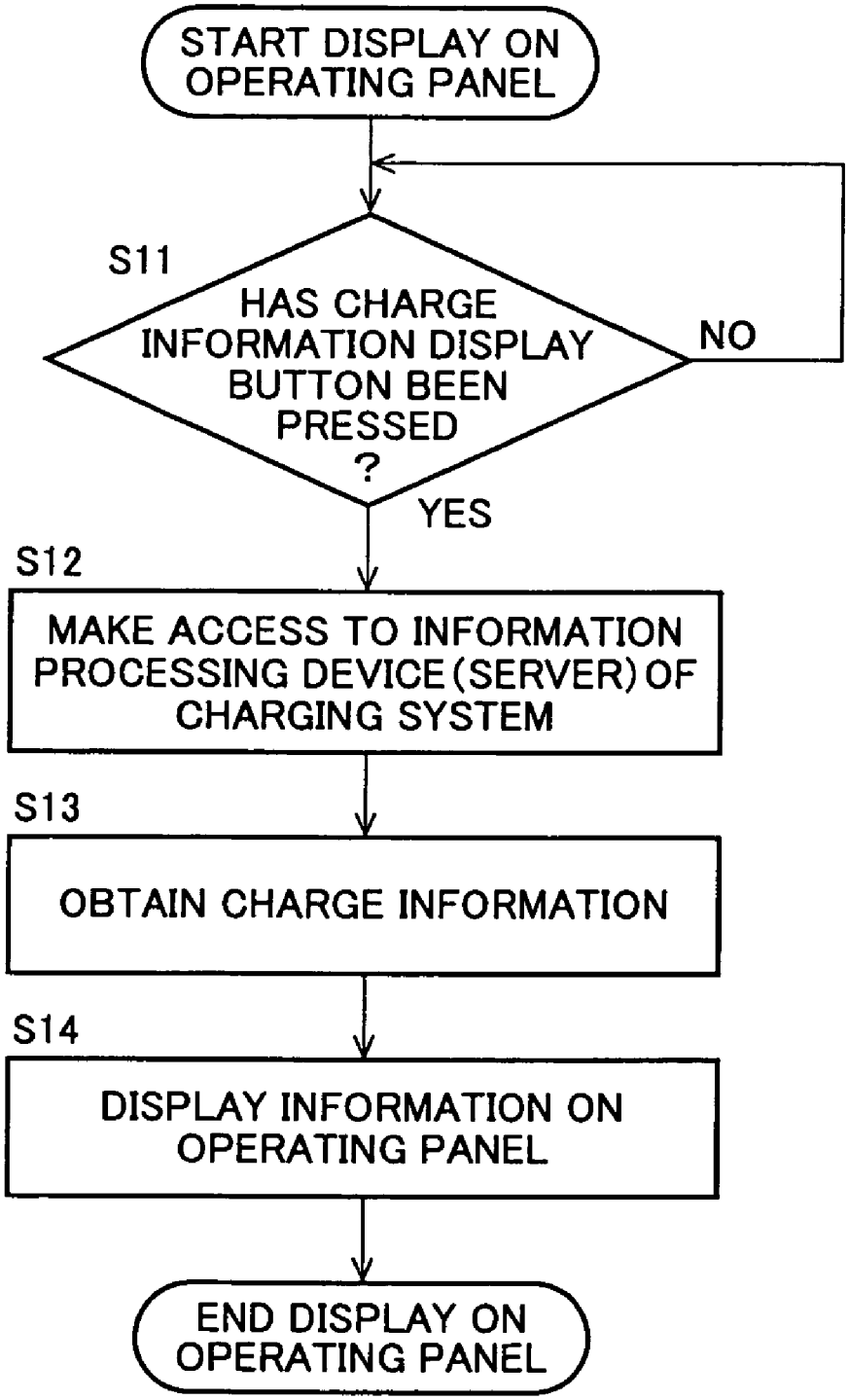
FIG. 9 is a flowchart for explaining an example of a processing that the digital multi-function peripheral accesses to the information processing device and obtains the charging information.

FIG. 9 is a flowchart for explaining an example of a processing that the digital multi-function peripheral 1 accesses to the information processing device 11 and obtains the charging information. At the start of the flowchart, the digital multi-function peripheral 1 determines on whether a prescribed charging information display button has been pressed (step S11). When the charging information display button has been pressed (YES at step S11), the digital multi-function peripheral 1 makes access to the information processing device 11 of the charging system (step S12), and obtains the corresponding charging information from the information processing device 11 (step S13). When the charging information display button has not been pressed at step S11 (NO at step S11), the digital multi-function peripheral 1 waits input at step S11.

The digital multi-function peripheral 1 then causes the display portion 5*b* to display the charging information obtained at step S13, or causes the image forming portion 3 to print out the charging information (step S14). In this manner, the user of the digital multi-function peripheral 1 can check charging information, which has been available for check only through a monthly bill of particulars, at anytime the user wants to.

Figure 10:
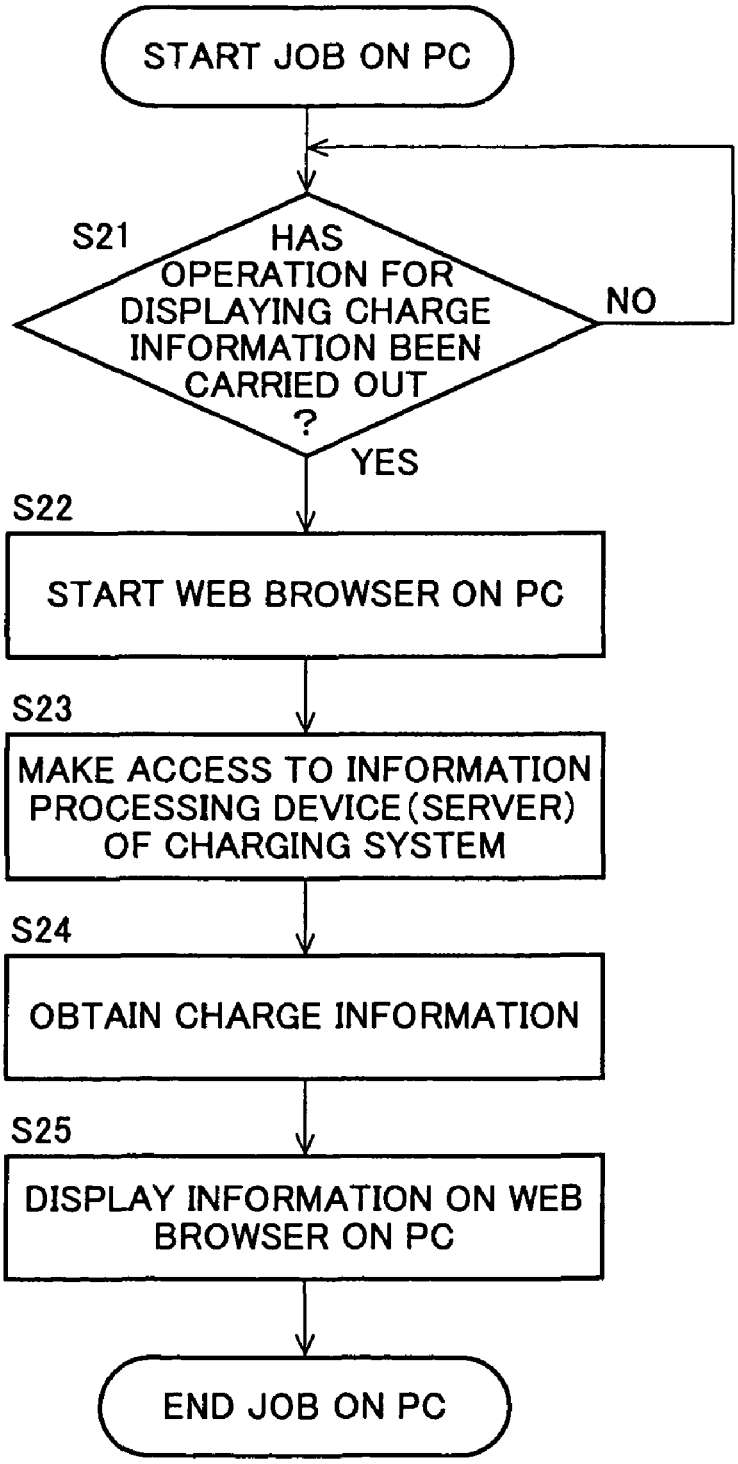
FIG. 10 is a flowchart for explaining an example of a processing that a PC accesses to the information processing device and obtains the charging information.

FIG. 10 is a flowchart for explaining an example of a processing that the PC 22 accesses to the information processing device 11 and obtains the charging information. At the start of the flowchart, the PC 22 determines on whether a given operation for displaying charging information has been carried out (step S21). When the operation for displaying charging information has been carried out (YES at step S21), the PC 22 starts a Web browser on the PC 22 (step S22), making access to the information processing device 11 of the charge system (step S23) to obtain the corresponding charging information from the information processing device 11 (step S24). When the operation for displaying charging information is not carried out at step S21 (NO at step S21), the PC 22 waits the operation at step S21.

The PC 22 then displays the charging information obtained at step S24 on the Web browser, or causes an external printer connected to the PC 22 to print out the charging information (step S25) In this manner, the user of the digital multi-function peripheral 1 can check charging information, which has been available for check only through a monthly bill of particulars, at anytime the user wants to check, using the PC 22. For example, if the user uses a plurality of the digital multi-function peripherals 1, the user can check charging information of every digital multi-function peripheral 1 all at once, using the PC 22.

FIG. 11 depicts an example of charging information displayed on the digital multi-function peripheral 1 or on the PC 22. The charging information exhibits (1) the total amount of service charge, (2) the detail of an amount of deduction, and (3) an amount of charge after balancing. When a jam caused by the user's error is found, adjustment due to the jam may be reflected in the charging information.

The embodiments of the present invention have been described so far centering on each function executed in the charging system of the present invention. In the above description, the present invention is described also as a method for executing each step in the charging system. The present invention, therefore, is provided also in the form of a charging method. In addition, the present invention can be provided also in the form of a program for causing a computer to function as the charging system, and also in the form of a recording medium recording the program, as provided in the form of the charging system having each function.

An embodiment of the recording medium recording programs/data for realizing the charging functions of the present invention will be described. Specifically, the recording medium may be any one of a CD-ROM (CD-R, CD-RW), magneto optical disc, DVD-ROM (DVD-R, DVD-RW, DVD-RAM), FD, HD, BD, flash memory, memory card, memory stick, and various ROMs and RAMs, etc. The program, which causes a computer to function as an apparatus operating according to the above embodiments of the present invention to offer a charging function, is recorded in the recording medium, and is distributed to facilitate the realization of the charging function. The recording medium is attached to an information processing device, such as computer, to allow the processing device to read out the program. Or, in another case, the program is stored in the recording medium incorporated in the information processing device, and is read out on a necessary basis. In this manner, the charging function according to the present invention can be executed.

As described above, the present invention enables detection of such a trouble as paper jam occurring on each image forming apparatus connected to a network, allowing deduction of the number of papers involved in the trouble from the total number of papers used according to the contents of the trouble to charge a user for service by the apparatus on the basis of a result of the deduction. This enables compensation for the user's loss in paying a charge due to a paper jam, etc. The invention, therefore, offers the user improved reliability, thus effective in acquiring more users.

The invention claimed is:

1. A charging system comprising at least one image forming apparatus and an information processing device for managing a charging processing on the image forming apparatus, the image forming apparatus and the information processing device being connected via a network, wherein the image forming apparatus has a trouble detecting portion that detects a trouble occurring on the image forming apparatus, and a use condition transmitting portion that transmits a total number of output papers outputted from the image forming apparatus and contents of the trouble detected by the trouble detecting portion to the information processing device, the total number and the contents of trouble being transmitted as a use condition of the image forming apparatus, and wherein the information processing device has a charge calculating portion that calculates a total amount of service charge on the basis of the total number of output papers transmitted from the image forming apparatus and an amount of deduction corresponding to the contents of trouble transmitted from the image forming apparatus, and that deducts the amount of deduction from the total amount of service charge to calculate an amount of charge on the image forming apparatus, wherein the amount of deduction is an amount that is calculated by adding up an amount of deduction per trouble for every contents of trouble, the amount of deduction per trouble being obtained by multiplying a frequency of each type of trouble occurred on the image forming apparatus by an amount corresponding to contents of each trouble.

2. The charging system as defined in claim 1, wherein the total amount of service charge is an amount that is calculated by multiplying the total number of output papers from the image forming apparatus by a charge for one paper based on a charge for use of the image forming apparatus, for expendable supplies, and for regular maintenance.

3. The charging system as defined in claim 1, wherein an amount of money corresponding to the contents of trouble varies for one output operation of the image forming apparatus according to a processing mode of the image forming apparatus.

4. The charging system as defined in claim 3, wherein the image forming apparatus has an image forming portion that executes a printing processing on a recording paper, and an image reading portion that executes a reading processing on a manuscript image, and wherein a processing mode of the image forming apparatus consists of a printing processing mode for making the image forming portion operate, and an original image reading processing mode for making the image reading portion operate.

5. The charging system as defined in claim 4, wherein the amount of money corresponding to the contents of trouble varies according to a transfer position of a recording paper in an operation in the printing processing mode.

6. The charging system as defined in claim 5, wherein the image forming apparatus has a paper feeding tray that stores recording papers, and a resist roller that transfers a recording paper sent from the paper feeding tray to the image forming portion, and wherein the amount of money corresponding to the contents of trouble varies depending on whether the recording paper from the paper feeding tray has passed through the resist roller.

7. The charging system as defined in claim 6, wherein the amount of money corresponding to the contents of trouble includes each charge per one output operation of the image forming apparatus for use of the apparatus, for expendable supplies, and for regular maintenance when the recording paper from the paper feeding tray has already passed through the resist roller.

8. The charging system as defined in claim 6, wherein the amount of money corresponding to the contents of trouble includes each charge per one output operation of the image forming apparatus for use of the apparatus and for regular maintenance when the recording paper from the paper feeding tray has not passed through the resist roller yet.

9. The charging system as defined in claim 4, wherein the image forming apparatus has a communication portion that transmits manuscript image data read by the image reading portion to an external device via a communication line, and wherein the amount of money corresponding to the contents of trouble includes each charge per one output operation of the image forming apparatus for use of the apparatus, for regular maintenance, and for connection to the communication line in an operation in the manuscript reading processing mode.

10. The charging system as defined in claim 1, wherein the charge calculating portion eliminates contents of a trouble caused by a given operation from contents of troubles detected on the image forming apparatus.

11. The charging system as defined in claim 1, wherein the information processing device has a charging information transmitting portion that transmits charging information including an amount of charge on the image forming apparatus calculated by the charge calculating portion to the image forming apparatus, and wherein the image forming apparatus is capable of displaying or printing out the charging information received from the information processing device.

12. A charging system comprising at least one image forming apparatus and an information processing device for managing a charging processing on the image forming apparatus, the image forming apparatus and the information processing device being connected via a network, wherein the image forming apparatus has a trouble detecting portion that detects a trouble occurring on the image forming apparatus, and a use condition transmitting portion that transmits a total number of output papers outputted from the image forming apparatus and contents of the trouble detected by the trouble detecting portion to the information processing device, the total number and the contents of trouble being transmitted as a use condition of the image forming apparatus, and wherein the information processing device has a charge calculating portion that calculates a total amount of service charge on the basis of the total number of output papers transmitted from the image forming apparatus and an amount of deduction corresponding to the contents of trouble transmitted from the image forming apparatus, and that deducts the amount of deduction from the total amount of service charge to calculate an amount of charge on the image forming apparatus, wherein the information processing device has a charging information transmitting portion that transmits charging information including the amount of charge on the image forming apparatus calculated by the charge calculating portion to another information processing device, and wherein another information processing device is capable of displaying or printing out the charging information received from the information processing device.

13. A charging method executed in a charging system comprising at least one image forming apparatus and an information processing device for managing a charging processing on the image forming apparatus, in which the image forming apparatus and the information processing device are connected via a network, wherein the method comprising the steps of:

causing the image forming apparatus to detect a trouble occurring on the image forming apparatus; and causing the image forming apparatus to transmit a total number of output papers outputted from the image forming apparatus and contents of the detected trouble as a use condition of the image forming apparatus to the information processing device, wherein the method further includes a step of causing the information processing device to calculate a total amount of service charge on the basis of the total number of output papers transmitted from the image forming apparatus and an amount of deduction corresponding to the contents of trouble transmitted from the image forming apparatus, and to calculate an amount of charge on the image forming apparatus by deducting the amount of deduction from the total amount of service charge, wherein the amount of deduction is an amount that is calculated by adding up an amount of deduction per trouble for every contents of trouble, the amount of deduction per trouble being obtained by multiplying a frequency of each type of trouble occurred on the image forming apparatus by an amount corresponding to contents of each trouble.

14. A computer readable storage medium for storing a program that when executed by a processor instructs the processor to perform functions of a charging system, comprising:

detecting a trouble occurring on an image forming apparatus;

transmitting to an information processing device a total number of output papers outputted from the image forming apparatus and contents of the detected trouble as a use condition of the image forming apparatus; and causing the information processing device to calculate a total amount of service charge based on the total number of output papers transmitted from the image forming apparatus and an amount of deduction corresponding to the contents of trouble transmitted from the image forming apparatus, and calculate an amount of charge on the image forming apparatus by deducting the amount of deduction from the total amount of service charge, wherein the amount of deduction is an amount that is calculated by adding up an amount of deduction per trouble for every contents of trouble, the amount of deduction per trouble being obtained by multiplying a frequency of each type of trouble occurred on the image forming apparatus by an amount corresponding to contents of each trouble.

* * * * *